United States Patent [19]

Watanabe et al.

[11] Patent Number: 4,855,637

[45] Date of Patent: Aug. 8, 1989

[54] OXIDATION RESISTANT IMPREGNATED CATHODE

[75] Inventors: Isato Watanabe, Hachioji; Shigehiko Yamamoto, Tokorozawa; Sadanori Taguchi, Tokyo; Susumu Sasaki, Kokubunji, all of Japan

[73] Assignee: Hitachi, Ltd., Tokyo, Japan

[21] Appl. No.: 155,813

[22] Filed: Feb. 16, 1988

[30] Foreign Application Priority Data

Mar. 11, 1987 [JP] Japan ..... 62-54160

[51] Int. Cl.[4] ..... H01J 19/14; H01J 1/14

[52] U.S. Cl. ..... 313/346 R; 313/337

[58] Field of Search ..... 313/346 R, 337, 352, 313/630, 633, 632; 428/336

[56] References Cited

U.S. PATENT DOCUMENTS 2,912,611 11/1959 Beck et al. ..... 313/337
4,518,890 5/1985 Taguchi et al. ..... 313/346 R
4,626,470 12/1986 Yamamoto et al. ..... 428/336
4,737,679 4/1988 Yamamoto et al. ..... 313/346 R

FOREIGN PATENT DOCUMENTS 509165 5/1977 U.S.S.R. ..... 313/346

*Primary Examiner*—Donald J. Yusko
*Assistant Examiner*—Michael Horabik
*Attorney, Agent, or Firm*—Antonelli, Terry & Wands

[57] ABSTRACT

An impregnated cathode comprising a cathode obtained by impregnating pore portions of a refractory porous substrate with an electron emissive material containing Ba and formed thereon a plurality of thin films made of a high melting metal and Sc, or a high melting metal and a Sc oxide, or a high melting metal, Sc and a Sc oxide, or a high melting metal and a compound of Sc, W and O, said thin films having the same composition but different densities can maintain good emission characteristics even after the sealing off step of tube production because the thin films formed on the cathode surface are oxidation-resistant.

9 Claims, 1 Drawing Sheet

OXIDATION RESISTANT IMPREGNATED CATHODE

BACKGROUND OF THE INVENTION

The present invention relates to an impregnated cathode capable of stably forming an atomic layer of low work function on the cathode surface.

Impregnated cathodes of high current density are promising for production of display tube, picture tube, pickup tube, etc of high resolution. As disclosed in Japanese Patent Unexamined Publication No. 61-183838, conventional impregnated cathodes comprise a cathode obtained by impregnating pore portions of a sintered W body with an electron emissive material and a thin film formed on the surface of the cathode, comprising a high melting metal and Sc or an Sc oxide, or of a high melting metal, Sc and a Sc oxide, or of a high melting metal and a compound of Sc, W and O. These cathodes are characterized by, during operation, having on the cathode surface a Ba/Sc/O complex layer of singe to several molecules and having a low work function.

In the above impregnated cathodes according to the prior art, no attention is paid to the point that the thin film formed on the cathode surface undergoes deterioration owing to thermal oxidation during the sealing off step of tube production. This deterioration of the thin film owing to thermal oxidation makes it impossible for the above impregnated cathodes to exhibit the intended properties.

SUMMARY OF THE INVENTION

An object of the present invention is to provide an impregnated cathode having an oxidation-resistant thin film on the surface.

The present invention provides an impregnated cathode comprising a cathode obtained by impregnating pore portions of a refractory porous substrate with an electron emissive material containing Ba and formed thereon a plurality of thin coating layers made of a high melting metal and Sc, or a high melting metal and a Sc oxide, or a high melting metal, Sc and a Sc oxide, or a high melting metal and a compound of Sc, W and O, said thin layers having the same composition but different densities.

DETAILED DESCRIPTION OF THE PREFERRED EMBODIMENTS

Figure 1:
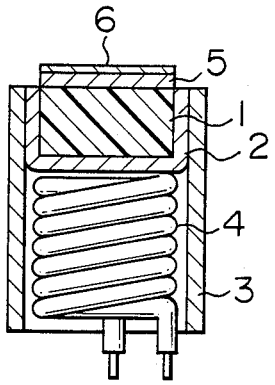
FIG. 1 is a sectional view showing an example of the impregnated cathode of the present invention.

The constitution, action and characteristics of the impregnated cathode of the present invention are described in detail below.

The impregnated cathode of the present invention is characterized in that the thin film formed on the cathode surface is constituted by a plurality of layers each of different density. Of these layers, it is preferable that the topmost layer has the highest density. This value of density reflects the packing degree of the thin film, and the thin film has a density of about 17 g/cm$^3$ when it has a packing degree of about 100%.

A thin film showing good emission characteristics has a low density. Therefore, such a thin film is easily oxidized as far as in the inner portion, is deteriorated in the sealing off step accompanying oxidation during the tube production, and as a result is unable to exhibit good emission characteristics. In contrast, in a thin film having a high density, oxidation occurs only at the topmost layer and does not proceed into the inner portion. The oxidation of the topmost layer has no effect on the emission characteristics because the topmost layer is evaporated in the activation and aging step after the tube production. The topmost layer of the thin film preferably has a density of 1.1 to 3.0 times that of the lowermost layer, and the thickness of the topmost layer is sufficient if it can prevent the lower layers from being oxidized and is preferably 10 to 100 nm. Formation of a plurality of layers with each of different density can easily be made by adopting different conditions for each layer in sputtering deposition, etc. The thin film comprising such a plurality of layers can be constituted, for example, mainly of W and $Sc_2O_3$, or W and a compound of W, Sc and O, and when the $Sc_2O_3$ content is 1 to 10 atomic % or when the $Sc_2W_3O_2$ content is 1 to 20 atomic %, good emission characteristics are exhibited. The impregnated cathode of the present invention has a thin film comprising a plurality of layers, preferably 2 to 5 layers, each of different density, on the cathode surface. However, said impregnated cathode may also be constituted in such a way that the whole thin film has a density gradient in the thickness direction, the lowermost layer has a density of 6 to 16 g/cm$^3$, and the topmost layer of the thin film in 10 to 100 nm thickness has a density of 1.1 to 1.3 times that of the lowermost layer. Such an impregnated cathode can be produced by continuously changing the conditions of sputtering.

In production of the impregnated cathode of the present invention by heating with a heater, a refractory porous body (substrate) having a porosity of preferably 15 to 30% and an electron emissive material are reacted with each other within a substrate cathode and the resulting Ba reaches the surface of the cathode through the pores; Sc and O are supplied onto the cathode surface from a thin film formed on the cathode surface; as a result, there is formed on the cathode surface a Ba/Sc/O complex layer of single to several molecules. Formation of this Ba/Sc/O complex layer on the surface of the W cathode enables the resulting cathode to have a reduced work function of about 1.2 eV and a high electron emission capability. However, this cathode has a drawback in that the thin film formed on the cathode surface is inevitably oxidized as far as in the inner portion of the thin film in the sealing off step accompanying oxidation during the tube production, resulting in the deterioration of the emission characteristics of the cathode. The reason can be explained below. In the formation of a Ba/Sc/O complex layer of single to several molecules for a reduced work function, W in the thin film is oxidized to form $WO_3$; $WO_3$ and other W oxides disappear in the activation and aging step after the tube production and thereby the thin film has an altered composition; as a result, the amounts and speeds of Sc and O supplied onto the cathode surface lose a balance to make it difficult to form a Ba/Sc/O complex layer having a low work function.

The study by the present inventors found that the formation of a thin film of high density on the cathode surface is effective for prevention of the oxidation of the thin film and formation of the Ba/Sc/O complex layer.

A thin film of high density allows the oxidation of the topmost portion of the film but hinders the proceeding of oxidation into the inner portion of the film. Hence, it is possible that the oxidation which inevitably occurs during the sealing off step of tube production be allowed to occur only in the topmost layer of higher density and not to proceed into the inner portion of the thin film. The above effect cannot be obtained when the topmost layer of the thin film has a density of less than 1.1 times that of the lowermost layer or has a thickness of less than 10 nm. Meanwhile, it is difficult to allow the topmost layer to have a density of more than 3.0 times that of the lowermost layer and such a high density is impractical as is a large thickness exceeding 100 nm. No effect of reducing the work function is obtained when the lowermost layer of the thin film has a density less than 6 g/cm$^3$. That the lowermost layer of the thin film has a density exceeding 16 g/cm$^3$ is practically difficult because the thin film has a density of about 17 g/cm$^3$ when its packing density is about 100%.

As described above, the topmost layer of the thin film is oxidized during tube production but disappears during the activation and aging step. Therefore, the present impregnated cathode can maintain good emission characteristics inherently possessed.

As the electron emissive material containing Ba, there can be used compounds containing Ba, alkaline earth metal oxides and $Al_2O_3$ or MgO. Usually compounds having the compositions of $BaCO_3$:$CaCO_3$:$Al_2O_3$=4:1:1 to 5:3:2 (in molar ratio) are used. The electron emissive material may further contain one or more rare earth oxides.

As the high melting metal for forming the alloy for the thin coating layers, there can be used, W, Mo, Ta, Re and compounds containing these elements.

As the Sc oxide, there can be used $Sc_2O_3$ preferably in an amount of 1 to 10 atomic % in the alloy, or $(Al, Sc)_2O_3$, $Sc_2W_3O_{12}$, $Ca_2Sc_2Ge_3O_{12}$, $(Ga, Sc)_2O_3$, $LiScO_{12}$, $LiScMoO_8$, $ScVO_4$, $(Sc, Y)_2O_3$, $Sc_4Zr_5O_{16}$, $8ZrO_2.Sc_2O_3$, preferably in an amount of 1 to 20 atomic % in the alloy. These Sc oxides may be used alone or as a mixture thereof.

It is preferable to use an alloy made of a compound of Sc, W and O such as $Sc_2W_3O_{12}$ together with W as the high melting metal mainly.

It is also preferable to use an alloy made of W and $Sc_2O_3$ mainly. In the case of an alloy of a high melting metal, Sc and a Sc oxide, the content of a total of Sc and the Sc oxide is preferably 1 to 20 atomic %.

Next, embodiments of the present invention are explained by referring to the accompanying drawings.

Figure 2:
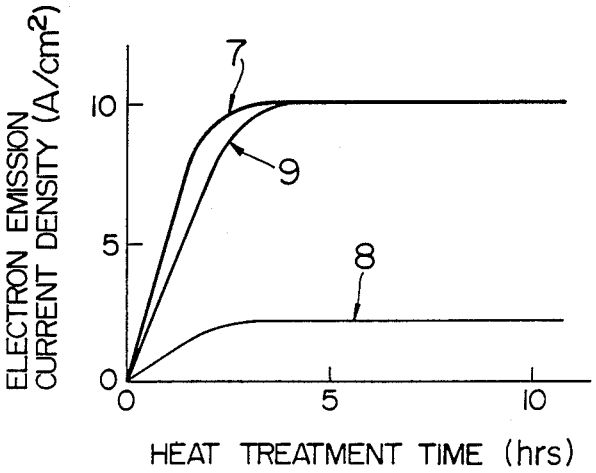
FIG. 2 is a diagram showing the changes with time, of the electron emission characteristics of various cathodes.

FIG. 1 is a sectional view showing an example of the impregnated cathode of the present invention. FIG. 2 is a diagram showing the changes with time, of the electron emission characteristics of various cathodes.

In FIG. 1, a W substrate 1 constituting a cathode was formed by subjecting a W powder having a particle diameter of 5 μm to press molding, presintering the resulting molding in a hydrogen atmosphere followed by sintering in vacuum to obtain a porous substrate having a porosity of 23%, and melt-impregnating the porous substrate with an electron emissive material having a composition of $4BaO.Al_2O_3.CaO$ in a hydrogen atmosphere. The W substrate 1 which is an impregnated cathode was placed in a cup 2 and then inserted into a sleeve 3. A heater 4 was placed beneath the cup 2 in the sleeve 3. On the upper surface of the W substrate 1 were formed two thin layers 5 and 6 each of different density. These two complex thin layers 5 and 6 were formed using a sputtering apparatus and changing the conditions such as Ar pressure and output power in the chamber. The compositions of the thin layers were measured by inductively coupled plasma spectroscopy and fluorescent X-ray spectroscopy. There were used, as the target for sputtering, those obtained by mixing a W powder and a $Sc_2O_3$ powder or a powder of a compound of W, Sc and O in various proportions and subjecting the mixture to press molding and then to sintering, whereby were formed various complex thin layers of different compositions and different thicknesses.

The thus produced impregnated cathode having complex thin layers 5 and 6 thereon was measured for electron emission capability while heating to about 900° C. (brightness temperature) by an alumina-coated W heater 4 in a vacuum container of about $10^{-9}$ Torr and applying pulse voltage in a diode configuration consisting of parallel plates of an anode and a cathode. The results of the measurement are shown in FIG. 2. FIG. 2 shows the electron emission characteristics of various cathodes. The curve 7 shows the characteristic of a cathode obtained by forming, on an impregnated cathode 1, a thin film whose topmost layer had a density of less than 1.1 times that of the lowermost layer. The curve 8 shows the characteristic of a cathode obtained by subjecting the above cathode to thermal oxidation which was similar to that occurring in the sealing off step of tube production. The curve 9 shows the characteristic of a cathode obtained by forming, on an impregnated cathode 1, a thin film comprising two layers of different densities, the topmost layer 6 having a density of 1.1 to 3.0 times that of the lowermost layer 5, the lowermost layer 5 having a density of 6 to 16 g/cm$^3$, the topmost layer 6 having a thickness of 10 to 100 nm, and the thin film having a total thickness of 40 to 400 nm. The thin film can have a maximum thickness of about 400 nm but the topmost layer 6 is preferred to have a thickness of not more than 100 nm.

In the typical cathode of the present invention, the thin film had a $Sc_2O_3$ content of 6 atomic %; the lower layer of the thin film had a density of 11 g/cm$^3$; and the upper layer had a density of 15 g/cm$^3$ and a thickness of 50 nm. The impregnated cathode obtained according to the present invention could maintain its inherent characteristic of electron emission even after the heat treatment similar to that experienced in the sealing off step of tube production, although the saturation time was delayed slightly. The surface of said cathode after thermal oxidation was subjected to Auger electron analysis, which indicated that the proportion of the single to several molecules layer (Ba/Sc/O) serving to reduce the work function remained almost unchanged after thermal oxidation.

It is learned from the above that the impregnated cathode of the present invention can be installed according to the currently employed steps of tube production, without sacrifying the good emission capability.

As described above, in the impregnated cathode of the present invention comprising a cathode obtained by impregnating the porous portions of a refractory, porous substrate with an electron emissive material containing Ba, and formed on the surface of the cathode, a plurality of thin coating layers made of a high melting metal and Sc, or of a high melting metal and a Sc oxide, or of a high melting metal, Sc and a Sc oxide, or of a high melting metal and a compound of Sc, W and O, said plurality of thin layers having the same composition but different densities. Adoption of such a thin film comprising a plurality of thin layers can allow the oxidation of the cathode surface experienced in the sealing off step during the tube production to occur only in the topmost layer having a higher density and not to proceed into the lower layers. As a result, the cathode characteristics before the sealing off step can be maintained even in a sealed tube. The topmost layer having a higher density not only serves to restrict the oxidation to that layer but also has a secondary effect of allowing the oxide layer formed in the sealing off step to more easily disappear in the activation and aging step after the tube production.

What is claimed is:

1. An impregnated cathode comprising a cathode obtained by impregnating pore portions of a refractory porous substrate with an electron emissive material containing Ba and a thin film formed on said cathode, said thin film comprising a plurality of thin coating layers made of a composition selected from the group consisting of a high melting metal and Sc; a high melting metal and a Sc oxide; a high melting metal, Sc and a Sc oxide; and a high melting metal and a compound of Sc, W and O; said thin coating layers having the same composition but different densities; wherein the density of a topmost layer of said thin film is 1.1 to 3.0 times the density of a lowermost layer of said thin film.

2. An impregnated cathode according to claim 1, wherein the density of the lowermost layer of the thin film is 6 to 16 g/cm$^3$.

3. An impregnated cathode according to claim 1, wherein the thickness of the topmost layer of the thin film is 10 to 100 nm.

4. An impregnated cathode according to claim 1, wherein the thin film is made of mainly W and $Sc_2O_3$ and the content of $Sc_2O_3$ is 1 to 10 atomic %.

5. An impregnated cathode according to claim 1, wherein the thin film is made of mainly W and $Sc_2W_3O_{12}$ and the content of $Sc_2W_3O_{12}$ is 1 to 20 atomic %.

6. An impregnated cathode according to claim 1, wherein the Sc oxide is at least one member selected from the group consisting of $Sc_2O_3$, $(Al, Sc)_2O_3$, $Sc_2W_3O_{12}$, $Ca_2Sc_2Ge_3O_{12}$, $(Ga, Sc)_2O_3$, $LiScO_{12}$, $LiScMoO_8$, $ScVO_4$, $(Sc, Y)_2O_3$, $Sc_4Zr_5O_{16}$ and $8ZrO_2.Sc_2O_3$.

7. An impregnated cathode according to claim 1, wherein said electron emissive material is a compound of $BaCo_3$:$CaCO_3$:$Al_2O_3$ in a molar ratio of 4:1:1 to 5:3:2.

8. An impregnated cathode according to claim 1, wherein said high melting metal is at least one of W, Mo, Ta, Re and compounds containing W, Mo, Ta or Re.

9. An impregnated cathode according to claim 1, wherein said thin film comprises two thin coating layers.

* * * * *